US005205776A

United States Patent [19]

Lenz

[11] Patent Number: 5,205,776

[45] Date of Patent: Apr. 27, 1993

[54] FIGURE TOY CONSTRUCTION WITH FLAT HAIR FIBERS

[76] Inventor: Carole A. Lenz, 6214 W. 129th Pl., Palos Heights, Ill. 60464

[21] Appl. No.: 670,982

[22] Filed: Mar. 18, 1991

[51] Int. Cl.[5] ..... A63H 3/44

[52] U.S. Cl. ..... 446/394; 446/385

[58] Field of Search ..... 446/394, 385, 319, 372, 446/27, 26, 268; 132/56, 53; 2/171, 175, 186, 185 R, 199, 198, 209.1, 200, 202, 192

[56] References Cited

U.S. PATENT DOCUMENTS 2,165,475 7/1939 Greneker ..... 446/394 X 2,835,259 5/1958 Goodman ..... 132/53

4,302,491 11/1981 Papageorgiou ..... 132/56 X

OTHER PUBLICATIONS

"Spectra", Mattel Catalog No. 3692, 1987, Hawthorne, Calif. 90250.

*Primary Examiner*—Mickey Yu

*Attorney, Agent, or Firm*—Leydig, Voit & Mayer

[57] ABSTRACT

A figure toy having a body and a head with a plurality of flat artifical hair fibers [6] on said head. The cross section of the artifical flat hair fibers has the largest dimention [4] between 0.01 in. and 0.25 in. and preferably between 0.01 in. and 0.1 in. Flat fibers can be utilized for artificial hair for toy dolls and various other applications.

6 Claims, 1 Drawing Sheet

FIG. 1
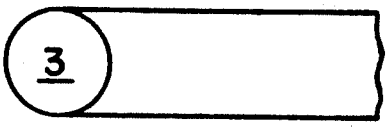
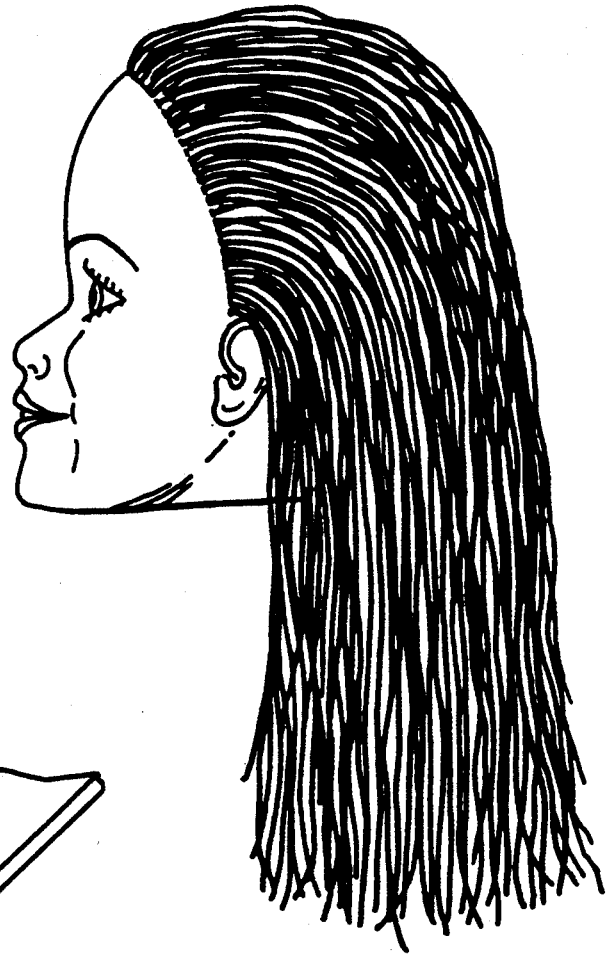
FIG. 3
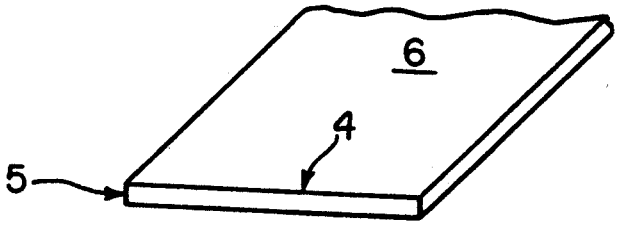
FIG. 2
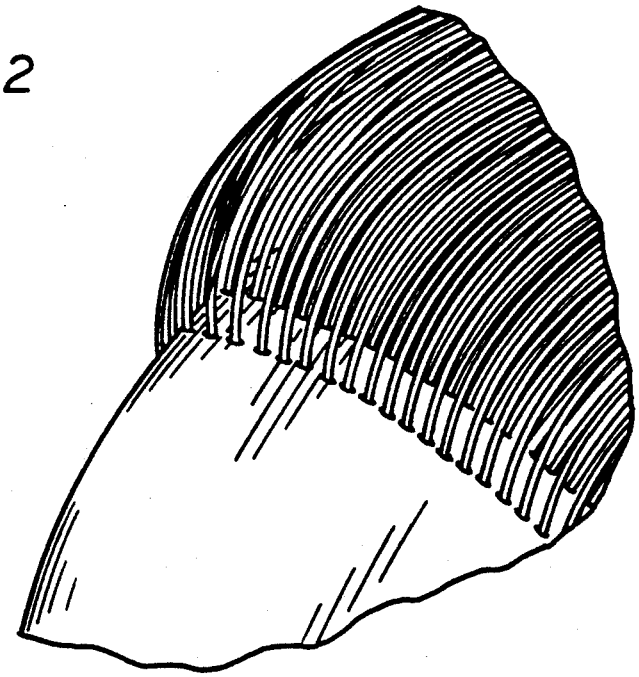
FIG. 4

FIGURE TOY CONSTRUCTION WITH FLAT HAIR FIBERS

BACKGROUND OF THE INVENTION

1. Field of the Invention

The present invention relates to a toy figure construction and more specifically to a toy figure with a head having artificial hair fibers.

2. Description of the Prior Art

Use of synthetic hair for toys in general and dolls in particular is a well known art. In this regard, conventional doll hair fibers are manufactured in such a manner as to resemble natural hair as close to real as possible. Each fiber can be visualized as a long tubular object having a cross section in the shape of a circle as thin as possible. Generally, the cross section of such a fiber has a diameter of less than 0.015 in. and is preferrably in the range between 0.002 in. and 0.004 in. These fibers are made of flexible and durable polymers such as polyolefins, polyesters, polyacrylonitrites, polyamides and polyvinyl chlorides.

It has been recently recognized that the hair look of a toy, such as a doll, is an important esthetic feature which adds substantially to the commercial significance of the doll. Thus, U.S. Pat. No. 3,382,607 describes the use of doll hair fibers permanently impregnated with an indicator dye and capable of repeated and reversible color change. The color change is achieved by contacting the hair with household liquids of different pH concentrations. The play value of a doll can be substantially enhanced and tends to stimulate the imagination of children by hair which glows in the dark, for example. Thus, U.S. Pat. No. 4,781,647 issued to Hasbro Inc. recently, describes the use and production of phosphorescent fibers made by the incorporation of phosphorescent agents to the synthetic fibers of the doll hair. The fascination of children playing with hair is the subject of yet another recent invention [U.S. Pat. No. 4,921,461], whereby training of the children in the use of scissors and in the modeling of hair styles of doll hair is described. Thus, the appearance of the hair in toys in general and dolls is particular plays a significant role in the commercial value of the toy.

Heretofore, hair used in dolls and other toys is made either of natural hair or plastic substitutes manufactured is such a manner as to resemble human hair as close as possible. Children however, are fascinated by the illusion of abstract, bright, eye appealling objects, different in shape then the natural ones. The latter has not yet been achieved in the field of doll hair, where all synthetic fibers used tend to resemble natural hair as close to real as possible.

Objects and Advantages

Accordingly, it is the primary object of this invention to provide doll hair, which further stimulates the imagination of children.

Another object of this invention is to provide doll hair which reflects the light substantially imparting the doll with a mystical pearlized look of an extraordinary lustreous appearance.

Another object of this invention is to provide doll hair with a wet shinning look without the hair being wet, which can be used for mermaid dolls for example.

Yet another object of this invention is to provide toy dolls with hair made by a more economical and easily accessible material.

Further objects and advantages of this invention will become apparent from a consideration of the drawings and ensuing description.

BRIEF DESCRIPTION OF THE DRAWINGS

FIG. 1 is an enlarged elevational view of a fiber heretofore used for doll hair.

FIG. 2 is an enlarged side elevation of the fiber in accordance with the instant invention.

FIG. 3 is a perspective view of the doll head with the fiber in accordance with the instant invention.

FIG. 4 is an enlarged view of a section of the doll head with the hair fiber.

DESCRIPTION AND SUMMARY OF THE INVENTION

FIG. 1 represents a tubular fiber for a typical doll hair which has a cross section 3 in the shape of a circle with a diameter less than 0.015 in. and preferably in the range between 0.004 in. and 0.002 in..

FIG. 2 represents a hair fiber of this invention, which is flat with a cross section having a rectangular shape, for example. The shorter diamention 5 is significant only in the sence that provides flexibility to the fiber and can be extremely thin. However dimention 4 is important, since it provides a flat surface where light can be substantially reflected. Diamention 4 can vary significantly between 0.0125 in. to 0.25 in.. However a range between 0.015 in. and 0.1 in. is preferred. This preferred range is approximately 10–30 times larger than the preferred cross section of the heretofore commonly used hair fiber. The fiber of this invention can be made of any flexible and durable polymers such as polyolefins, polyesters, polyacrylonitries, polyamides and polyvinyl chlorides. Especially suitable are fibers of this invention which have been metallized or treated chemically by well known methods which impart a metallic like look to the fiber with high reflectance. Especially suitable for the hair of this invention are the well known plastic strands of icicles used on Christmas trees for example.

Such strands are sold by Union Webbing Company, Pawtucket, R. I. under the name of Ice Luster, by Tinsel Company of America, Wisconsin under the name of Crystal Ice and others. These strands are approximately 0.05 in wide and are made of metalized polyvinyl chloride. Said strands are flame resistant, waterproof, sparkling and come in various colors such as silver, pink, red, yellow etc.

The doll hair fibers of this invention can be attached permanently to the head of the doll or can be converted to wigs for dolls by common methods, well known in the art.

Thus the reader will see, that the flat fibers described in the present invention provide a highly desirable, light reflective, sparkling material extremely suitable for use as doll or toy hair, yet it is economical and easily accessible.

While the above description contains many specifications, there should not be construed as limitations on the scope of this invention, but rather as an exemplification of one preferred embodiment thereof. Accordingly, the scope of the invention should be determined not by the embodiment illustrated, but by the appended claims and their legal equivalents.

What is claimed is:

1. A toy doll head having hair wherein said hair is formed entirely from a plurality of individual substantially flat flexible metallized polyvinyl chloride fibers, said fibers having a cross section with the longest dimension in the range of from about 0.01 inches to about 0.10 inches.

2. A figure toy having improved hair facilitating the enjoyment of the toy figure by a child wherein the entirety of said hair is formed from a plurality of individual substantially flat flexible and durable synthetic polymeric fibers.

3. The figure toy of claim 2 wherein said fibers have a cross section with the longest dimension in the range of from about 0.01 inches to about 0.25 inches.

4. The figure toy of claim 3 wherein said fibers have a cross section with the longest dimension in the range of from about 0.01 inches to about 0.10 inches.

5. The figure toy of claim 2 wherein said fibers present a metallic appearance.

6. The figure toy of claim 2 wherein said fibers are selected from a variety of colors.

* * * * *